United States Patent [19]

Yanessa

[11] 4,222,201

[45] Sep. 16, 1980

[54] SLIDING, PIVOTING WINDOW

[75] Inventor: Silvio F. Yanessa, Langhorne, Pa.

[73] Assignee: Air Master Corporation, Cornwells Heights, Pa.

[21] Appl. No.: 958,290

[22] Filed: Nov. 6, 1978

[51] Int. Cl.[2] ..... E05D 15/22

[52] U.S. Cl. ..... 49/189; 49/174

[58] Field of Search ..... 49/180, 177, 183, 149, 49/168, 161, 162, 174, 175, 421, 188, 189

[56] References Cited

U.S. PATENT DOCUMENTS

| | | | |
|---|---|---|---|
| 1,029,274 | 6/1912 | Caler | 49/174 |
| 1,082,663 | 12/1913 | Viragh | 49/149 X |
| 1,226,145 | 5/1917 | Taylor | 49/149 |
| 2,375,546 | 5/1945 | Gaines et al. | 49/175 X |
| 2,452,119 | 10/1948 | Garros | 49/149 |
| 2,747,241 | 5/1956 | Marousky | 49/149 |
| 3,055,063 | 9/1962 | Peters | 49/174 |
| 3,099,050 | 7/1963 | Hetman | 49/421 |
| 3,318,047 | 5/1967 | Carson | 49/149 |
| 3,464,157 | 9/1969 | Rodriguez | 49/161 |
| 3,590,530 | 7/1971 | Duguay | 49/161 |

OTHER PUBLICATIONS

Thermal Barrier Window Products Brochure.

*Primary Examiner*—Philip C. Kannan

*Attorney, Agent, or Firm*—Caesar, Rivise, Bernstein & Cohen, Ltd.

[57] ABSTRACT

A structural panel, such as a window or door sash which is mounted for horizontal sliding movement between a pair of tracks forming its frame and which is pivotable about a vertical axis extending through a pair of apertures in the tracks. The sash is supported for movement along the tracks by respective carriers located adjacent each corner of the sash. The sash includes releasable locking means located within one stile and a pair of pivot assemblies located in the other stile. Each pivot assembly includes a rod which is extendable vertically through an aligned carrier and into the aperture in the associated track. The carrier into which the rods extend includes a rotatable mount to enable the sash to be pivoted out of the frame when the releasable locking means is released.

15 Claims, 8 Drawing Figures

SLIDING, PIVOTING WINDOW

This invention relates generally to structural panels such as windows and doors and more particularly to horizontally moveable panels which are arranged to be pivoted about a vertical axis.

Various sliding windows and doors having the ability to be pivoted about an axis to provide ready access to their exterior for cleaning and repair have been disclosed in the patent literature and many such windows are commercially available. For example, U.S. Pat. Nos. 1,082,663 (Viragh), 1,226,145 (Taylor), 2,375,546 (Gaines et al), 2,452,119 (Garros), 2,747,241 (Marousky), 3,055,063 (Peters), 3,099,050 (Hetman), 3,464,157 (Rodriguez), and 3,590,530 (Duguay) disclose windows having vertically slideable sashes and which can be pivoted about a horizontal axis to facilitate cleaning the exterior surface thereof. Such windows make use of various types of window pivot mechanisms. For example, the window in U.S. Pat. No. 1,082,663 (Viragh) makes use of a spring biased horizontally disposed pivot pin which is located within a vertically slideable window sash and is arranged to be extended horizontally from the sash into the jamb of the frame to provide a horizontal axis about which the sash can be pivoted. The window in U.S. Pat. No. 2,452,119 (Garros) includes another type of horizontally extensible pivot pin, as do the windows disclosed in U.S. Pat. Nos. 2,747,241 (Marousky), 3,099,050 (Hetman) and 3,464,157 (Rodriguez). Other types of pivot means are disclosed in the U.S. Pat. Nos. 3,055,063 (Peters) and 2,375,546 (Gaines et al).

Horizontally sliding panels having the ability to be pivoted about a vertical axis have also been disclosed in the patent literature. For example, in U.S. Pat. No. 3,318,047 (Carson) there is disclosed sliding doors having a slide assembly which itself is provided out of the door frame to enable the doors supported thereby to be swung open either in its closed or partially closed position.

While the aforementioned prior art sliding window and door structures exhibit the ability to be pivoted out of their supporting frame for cleaning and maintenance, they nevertheless leave much to be desired from the standpoint of simplicity of construction and ease and effectiveness of operation.

Thermal Barrier Window Products, Inc., of Bedford, Ohio, offers a horizontally sliding window which is pivotable about a vertical axis on opposed pivot rods. The pivot rods are arranged to be extended into the slide elements which carry the window horizontally along its horizontally disposed support tracks. Due to the manner in which the window is supported, during pivoting it appears susceptible to being tilted accidentally out of its desired vertical orientation, which action may result in the window falling out of the frame.

Accordingly, it is a general object of the instant invention to overcome the disadvantages of the prior art.

It is a further object of the instant invention to provide a window or door which is arranged to slide horizontally to a pivoted position at which it can be pivoted about a vertical axis.

It is still a further object of the instant invention to provide a horizontally slideable, pivotable window or door sash which is simple in construction.

It is yet a further object of the instant invention to provide a horizontally slideable window or door sash which can be pivoted about a vertical axis for cleaning but which is resistant to tilting from its vertical orientation.

These and other objects of the instant invention are achieved by providing a panel adapted to slide horizontally along a first track and to be pivoted about a vertical axis located at a predetermined position in said track. The panel comprises a sash including a stile and a bottom rail. Carrier means are connected to the bottom rail and disposed within the track to enable the sash to slide therealong. Releaseable retaining means hold the panel within the track. Pivot means are mounted on the sash and comprise at least a first reciprocable member having a free end extending vertically. The member is mounted on the stile and arranged to be moved vertically from a retracted position to an extended position wherein its free end extends out of the sash, through the carrier means and into an opening in the track at said predetermined location to provide a vertical axis about which the panel can be pivoted when the retaining means is released.

Other objects and many of the attendant advantages of the instant invention will be readily appreciated and understood by reference to the following detailed description when considered in connection with the accompanying drawings wherein.

Figure 1:
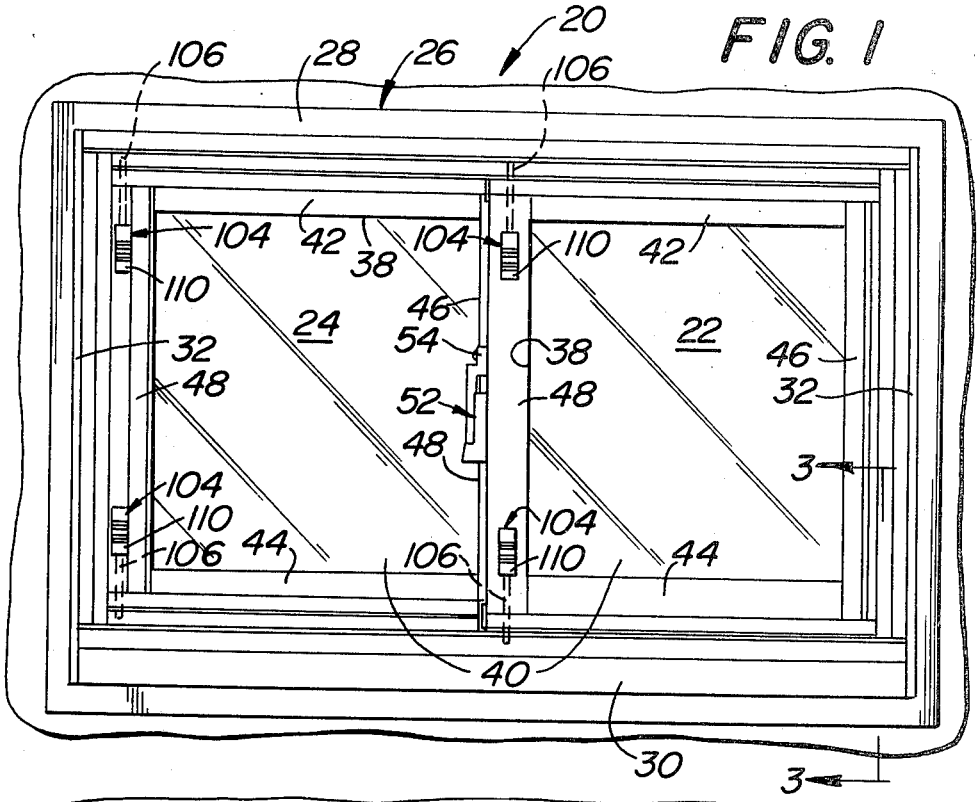
FIG. 1 is a front elevational view of a window unit in accordance with the instant invention and shown with its sashes closed.

Referring now to the various figures of the drawing wherein like reference numerals refer to like parts, there is shown generally at 20 in FIG. 1 a window unit including a pair of horizontally sliding and pivotable window sashes 22 and 24 constructed in accordance with the instant invention.

It must be pointed out at this juncture that the instant invention is not limited to window sashes but relates to any structural panel, e.g., a patio door, which is arranged for horizontal movement.

Figure 3:
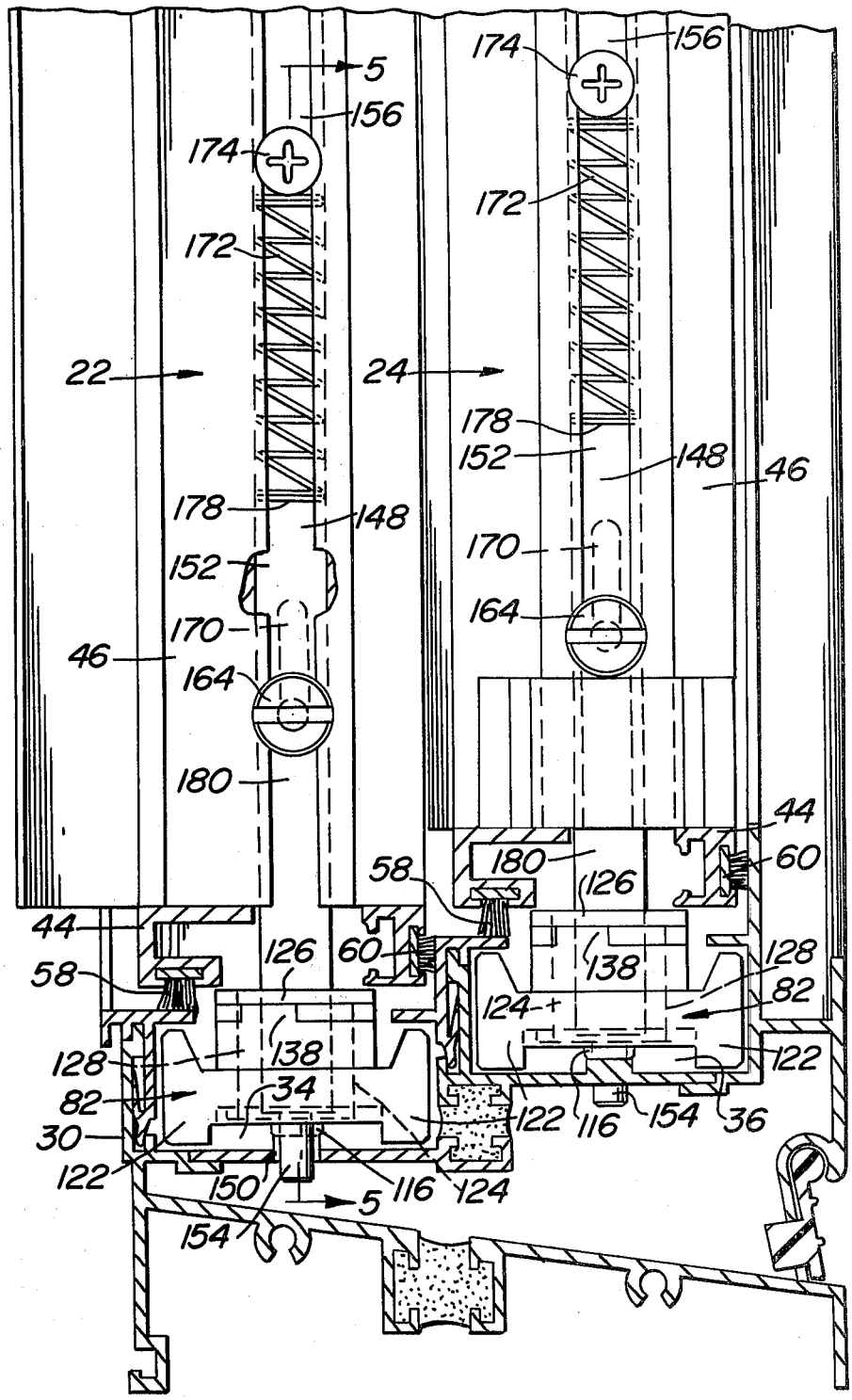
FIG. 3 is an enlarged sectional view taken along line 3—3 of FIG. 1.

As can be seen in FIG. 1, the sashes 22 and 24 are mounted within a window frame 26. The frame 26 is of generally conventional construction, is preferably formed of aluminum extrusions, and basically comprises a horizontal head 28, a sill 30 and a pair of side members or jambs 32. The head 28 and sill 30 are of substantially identical construction, hence only the sill is shown in detail herein, and each includes a pair of horizontally disposed tracks 34 and 36 (FIG. 3). The sill track 34 of the sill 30 is coplanar with the corresponding head track of the head 28 while the sill track 36 of the sill 32 is coplanar with the corresponding head track of the head 28.

Each window sash basically comprises a frame 38, supporting an insulating glass panel 40. The frame includes an upper rail 42, a lower rail 44 and a pair of vertical stiles 46 and 48. The glass panel 40 is of conventional construction and is formed by a pair of glass panes 50 (FIG. 4) disposed vertically parallel to one another but spaced apart to create an insulating air space therebetween.

The window sash 22 is mounted within the window frame 26 with its upper rail 42 disposed within head track 34 of the head 28 and with its lower rail 44 disposed within sill track 34 of the sill 30. Carrier means, to be described in detail later, are mounted on the upper and lower rails to enable the sash to be slid horizontally down the tracks 34 to open or close the window. The window sash 24 is similarly mounted within the window frame 26 except that its upper rail is disposed within the head track 36 of the head 28 while its lower rail is disposed within the sill track 36 of the sill 30. Carrier means are also mounted on the upper and lower rails of the sash 24 to enable it to be slid horizontally along its tracks 36.

As is conventional, the window unit 20 includes a latch for securing the sashes together to lock them in place in their closed position shown in FIG. 1. To that end the latch 52 includes a moveable clasp element 54 mounted on the stile 48 of sash 22 and a stationary catch 56 mounted on stile 46 of the sash 24 for receipt of and engagement with the clasp 54.

Figures 4, 7:
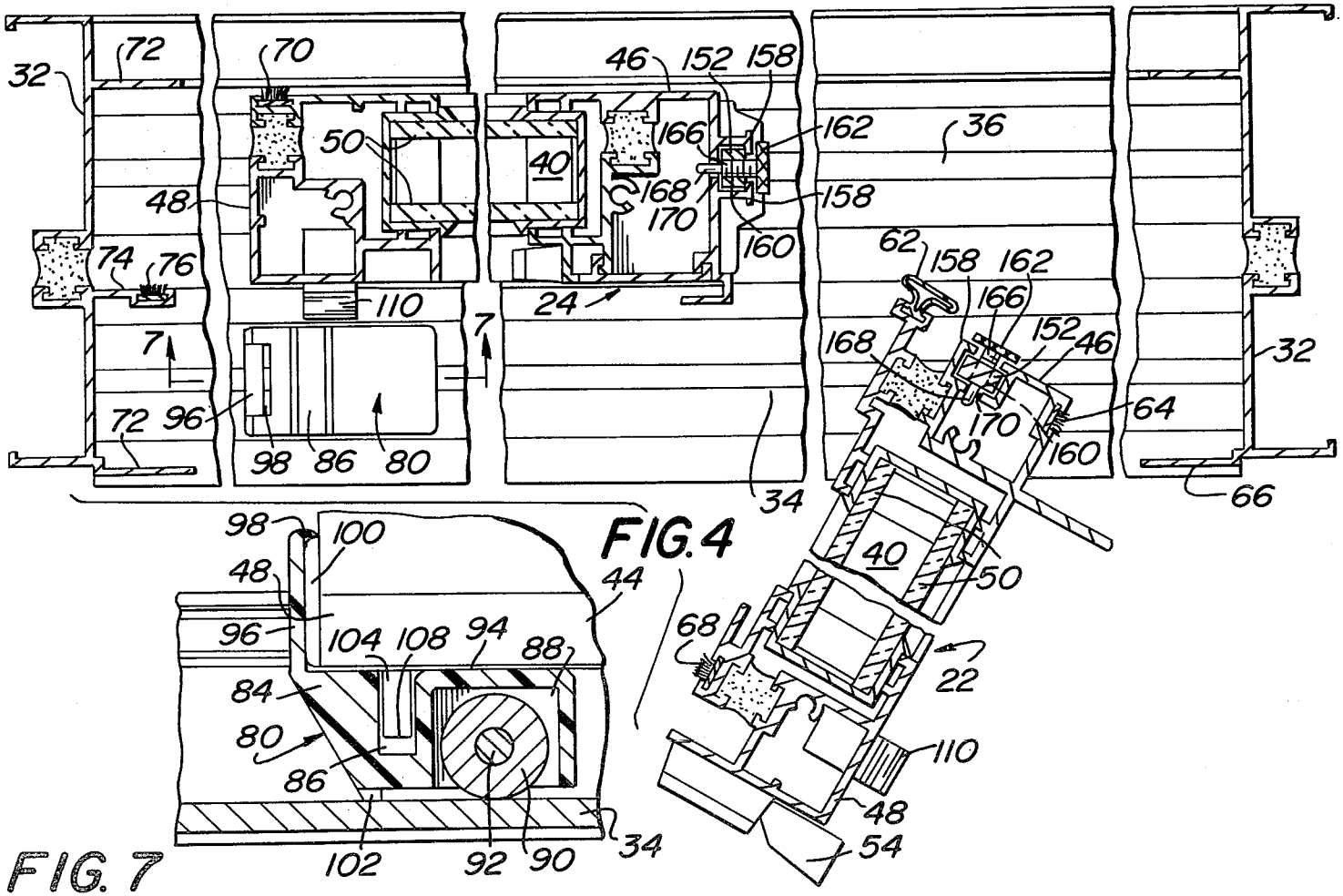
FIG. 4 is an enlarged sectional view taken along line 4—4 of FIG. 2.
FIG. 7 is an enlarged sectional view taken along line 7—7 of FIG. 4.
Figure 6:
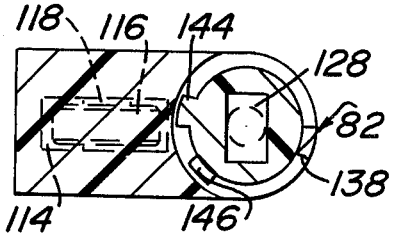
FIG. 6 is a sectional view taken along line 6—6 of FIG. 5.

The top rail 42 and the bottom rail 44 of each sash are of identical construction. Therefore, only bottom rail 44 of sashes 22 and 24 is shown in detail in the drawings herein. As can be seen in FIG. 3 each rail 44 is a hollow extrusion including a pair of plush material, weather strips 58 and 60 extending horizontally along the full length of the rail and arranged to abut the contiguous portions of the associated track extrusion to provide an airtight seal between the rail and the track. As shown in FIG. 4 the stile 46 of each sash is of a tubular construction and includes a resilient material, e.g., rubber, tubular weather strip 62 extending vertically along the entire height of the stile contiguous with the outside face of the sash 22. The resilient weather strip 62 is arranged to form an airtight seal between the stile of sash 22 and the jamb 32 of the window frame when the sash 22 is closed, i.e., in the position shown in FIG. 1. A plush material weather strip 64, like weather strips 58 and 60, is mounted on the stile 46 and extends vertically along the inside face of the sash 22 for the entire height of the stile. The weather strip 64 is arranged to engage a vertical flange 66 projecting inward from the jamb 32 of the window frame to form a weather tight seal when the sash is closed. Another, plush material weather strip 68 is mounted vertically along stile 48 of the sash 22 contiguous with the outside face of the sash. The weather seal 68 extends the entire height of the stile 48 and engages the inner face of the stile 46 of the sash 24 to form a weather tight seal between the sashes 22 and 24 when the sashes are closed, as shown in FIG. 1.

The sash 24 includes a single vertically oriented, plush material, weather seal 70 mounted along the outside surface of the stile 48. The seal 70 extends the entire height of the stile and is adapted to engage a flange 72 which projects inward from the other jamb 32 for the entire length thereof. The jamb 32 also includes an intermediate flange 74 which projects into the frame and extends the entire height of the jamb. The flange 74 includes a weather strip 76 extending the entire length thereof and adapted to engage the inner surface of the stile 48 of sash 24 to form a weather tight seal therewith.

In accordance with the main aspect of the invention, each sliding sash 22 and 24 is arranged to be slid to a respective predetermined position within the window frame 26 to permit it to be pivoted about a vertical axis out of the plane of the frame. The pivoting feature facilitates access to the exterior of each sash to clean it from inside the building.

In order to effect the sliding of the sashes 22 and 24 along their respective tracks, each sash includes two pairs of carriers 80 and 82, one pair, referred to as the upper carriers, is connected to the top rail 42, and the other pair, referred to as the lower carriers, is connected to the bottom rail. The upper and lower carriers 80 are of identical construction to each other as are the upper and lower carriers 82. The upper carrier 80 of each sash is mounted on its associated top rail at the corner of the top rail and the stile 48. The lower carrier 80 for each sash is mounted on the lower rail 44 at the corresponding corner. The upper carrier 82 is mounted on the top rail of its associated sash at the corner of the top rail and the stile 46. The lower carrier is mounted at the corresponding corner on the lower rail 44.

The details of the lower carrier 80 (and hence the upper carrier 80) is shown clearly in FIGS. 4 and 7. As can be seen therein, each carrier 80 basically comprises a body portion or block 84 having a transversely extending channel 86 and a cavity 88. The cavity includes a mouth which is open immediately adjacent to the track 34 in which the carrier is disposed. A roller 90, having an axle 92, is mounted within the cavity with the axle extending perpendicularly to the longitudinal axis of the track to enable the roller to roll along the track to carry the carrier therealong. The carrier is disposed within the track with its top surface 94 supporting the lower rail at the stile 48 end of the sash. The forward end of the carrier body 84 is in the form of an upstanding finger 96 having a flanged free end 98 which overhangs and engages a dust cap plate 100 mounted on the lower end of the stile 48. The finger serves to secure the carrier 80 to the sash. In order to keep the top surface 94 of the carrier body 84 parallel to the track 34 along which it is moved, the body includes a pair of feet 102 projecting downward from its underside forward of the roller 90. In accordance with the preferred aspect of this invention each carrier body is formed of a tough, yet freely slideable, material, such as Nylon, while the roller is formed of a metal, such as bronze.

Figure 2:
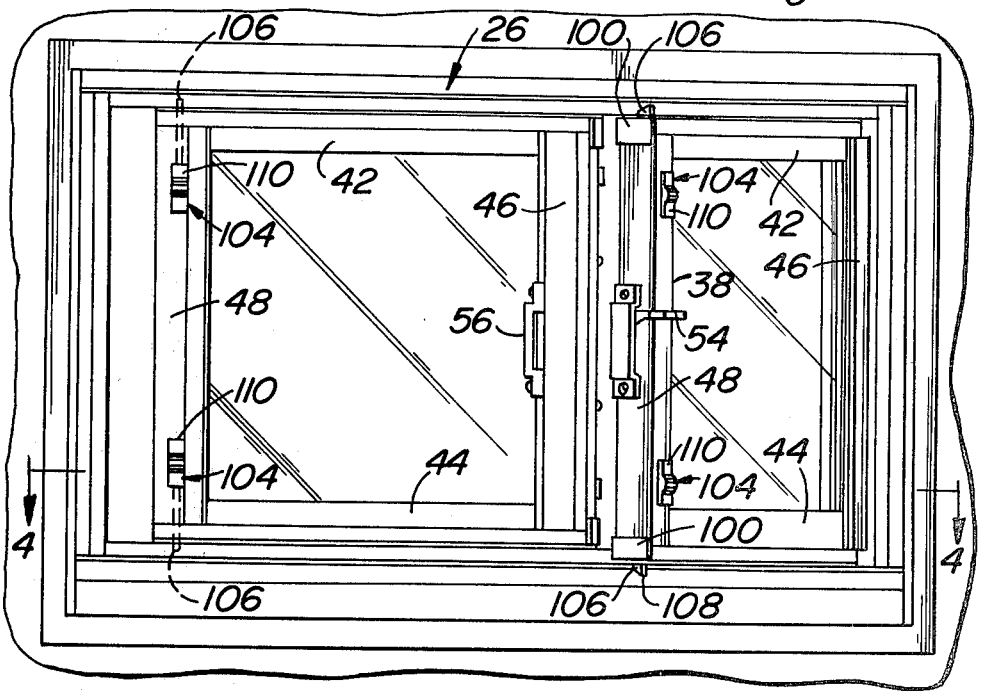
FIG. 2 is a front elevational view of the window shown in FIG. 1 but with one sash thereof pivoted open.

As can be seen in FIGS. 1, 2 and 4 each sash 22 and 24 includes a pair of releasable mechanisms 104 for locking the sash within the plane of its supporting track. Each mechamism 104 comprises a finger 106 mounted within a longitudinally extending channel (not shown) in stile 48. Each finger 106 is biased by means (not shown) so that its free end 108 (FIG. 7) extends out of its associated rail 42 or 44 and into the transversely extending channel 84 in the associated carrier 80. A respective slide button 110 is connected to each finger 106. Each button is mounted on the stile and is arranged, when manually pulled toward the center of the stile, to retract the finger end 106 from the channel 84 in the associated carrier 80. This action frees the stile 48 end of the sash to enable it to be pivoted out of the plane of its supporting tracks, while leaving the top and bottom carriers 80 disposed therein.

The details of the means for establishing the vertical pivot axis about which each sash can be pivoted out of the plane of its supporting tracks can best be understood by reference to FIGS. 3, 5, 6 and 8. As will be described hereinafter, such means includes pivot assemblies, the carriers 82 identified heretofore, and apertures located at predetermined positions in the tracks 34 and 36.

Each carrier 82 comprises a body portion 112 having a cavity 114 which is open on the side of the body facing the track in which the carrier is disposed. A roller 116, having an axle 118, is mounted within the cavity 114, with the axle of the roller extending perpendicularly to the longitudinal axis of the track to enable the roller to roll therealong carrying the carrier therewith.

The top surface 120 of the body 112 is planar and is arranged to abut the outer surface of the rail 42 or 44 associated therewith.

The carriers 82 are constructed of the same materials as the carriers 80.

Figure 8:
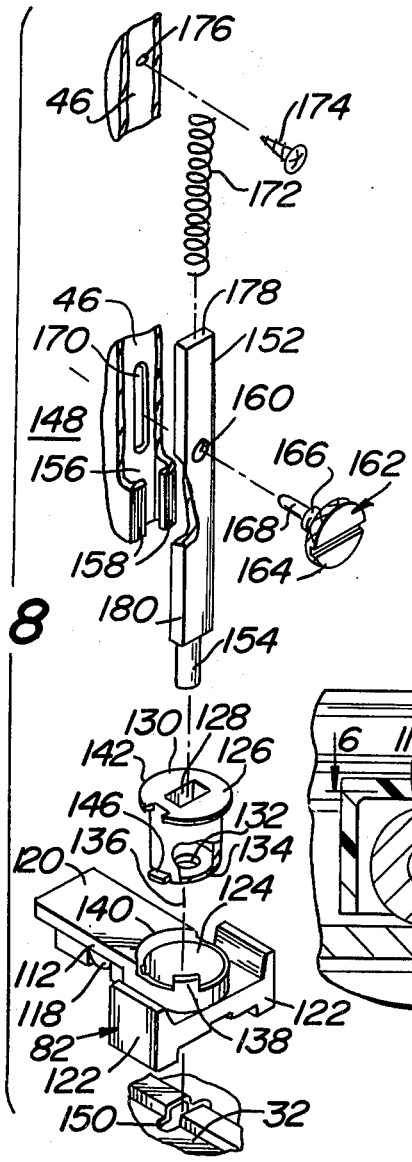
FIG. 8 is an exploded perspective view of a portion of the window shown in FIG. 5.

As shown clearly in FIGS. 3 and 8 the front portion of the body 112 includes a transversely projecting opposed pair of ears 122. The ears are disposed immediately adjacent to the side walls of the extrusion forming the track in which the carrier is disposed to aid in guiding the movement of the carrier longitudinally down the track. A cylindrical well 124 extends vertically through the forward portion of the body 112 between the opposed ears 122. A cylindrical insert 126 is located within the well 124 and includes a rectangular passageway 128 extending through the top wall 130 for a substantial distance into the body of the insert. The lower end 132 of the passageway, which communicates with the bottom wall 134 of the insert is circular. The outer diameter of the circular side wall of the insert is slightly less than the inner diameter of the well to enable the insert to be freely rotatable within the well about the vertical axis thereof. The vertical axis is shown by the broken line identified by the reference numeral 136 in FIG. 8. A tab 138 projects upward from the forward portion of the body contiguous with the well 124. The top surface of the tab is coplanar with the portion 140 of the top surface 120 of the body 112 contiguous with the rear of the well so that the periphery of the top wall 130 of the insert forms a flange 142 which overlies the top surface of the tab 138 and the portion 140, thereby supporting the insert within the well. A projection 144 (FIGS. 5 and 6) underlies the flange 140 and is arranged to contact the upstanding tab 138 to restrict the rotation of the insert to less than 360° within the well. A finger 146 (FIG. 6) projects horizontally from the bottom wall of the insert and extends over the portion of the underside of the body contiguous with the well to hold the insert in place in the well.

As noted heretofore, pivot assemblies are provided on each sash to effect the pivoting action thereof. The pivot assemblies are identified by reference numeral 148 and are mounted coaxially on stiles 46 of each sash 22 and 24. Each pivot assembly 148 is arranged to cooperate with the insert plug 126 of an associated carrier 82 to enable the sash to be pivoted about a vertical axis when the sash is at a predetermined position with the window frame. The vertical axis about which each sash is arranged to pivot is located at said predetermined position and is defined by aligned holes in the top and bottom tracks and located thereat. To that end, the sill track 34 includes an aperture 150 located closely adjacent to the right side jamb 32 of the window frame as shown in FIG. 1, while the head track 34 includes an identical opening 150 located directly over the aperature in the sill track. The line connecting these two apertures 150 forms the axis about which the sash 22 is arranged to be pivoted. In a similar manner, the sill track 36 includes an aperture (not shown) which is located slightly to the right of the middle of the window frame, while the head track 36 includes an identical opening located directly over the aperture in the sill track. The two vertically aligned openings in the head and sill tracks 36 establish the axis about which the sash 24 is arranged to be pivoted.

In FIG. 2 window sash 22 is shown pivoted slightly out of the plane of the window frame while sash 24 is shown located within the plane of the frame but at the longitudinal position along the frame from which it can be pivoted outward.

Since the pivot assemblies 148 are of identical construction only the pivot assembly located on the lower portion of stile 46 of the sash 22 will be described in detail herein.

Figure 5:
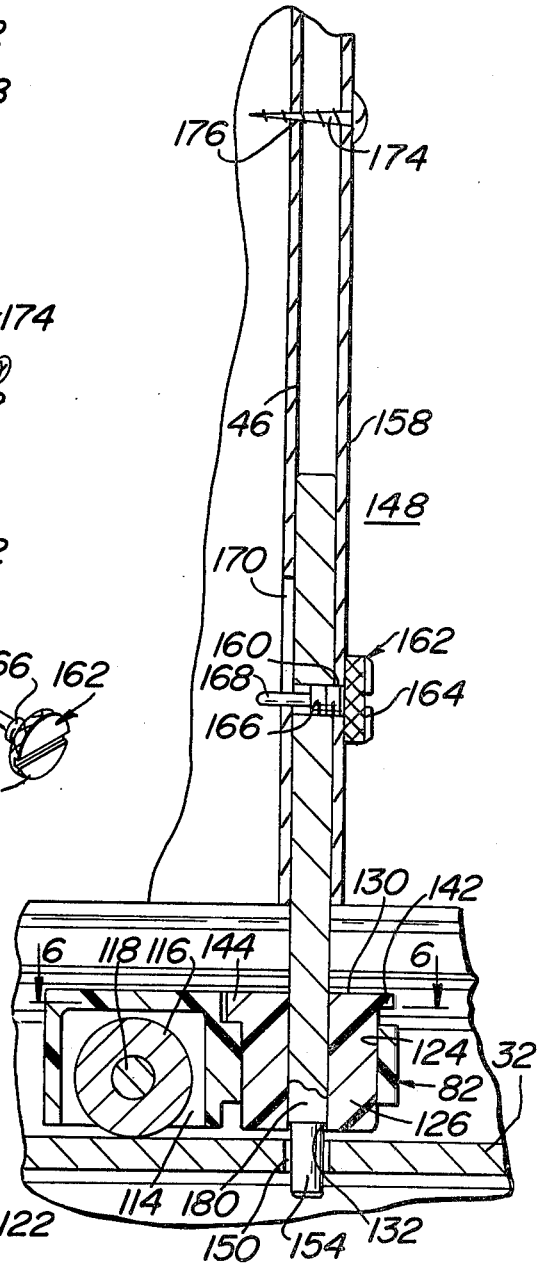
FIG. 5 is a sectional view taken along line 5—5 of FIG. 3.

To that end, as can be seen in FIGS. 5 and 8 the pivot assembly 148 comprises an elongated rod-like element 152. The rod 152 is of generally rectangular cross section except for its free end 154 which is circular in cross section. The rod 152 is disposed longitudinally within a vertically extending flat sided channel 156 in the stile 46 of the sash. The channel is formed by an opposed pair of side walls 158 and includes a vertically extending slot therebetween. A threaded hole 160 extends through the midportion of the rod. A screw 162 having an enlarged knurled head 164 and a shank including an intermediate threaded portion 166 and an unthreaded free end 168 extends through the slot between the channel side walls 158 and into the hole 160 in the rod 152, with the threaded shank portion 166 in engagement with the threaded hole 160. The free end 168 of the screw extends out of the opening 160 in the rod and into an underlying elongated vertical slot 170 in the base of the channel 156.

The cross sectional area of the rod is such as to permit it to be slid up and down the channel by the application of manual force on the screw head 164. The limits of travel of the rod are established by the length of the slot 170 since the screw end 168 is disposed within the slot.

A compression spring 172 is located within the channel 156. A screw 174 extends into an opening 176 in the stile 46 and serves as a stop to locate the upper end of the spring within the channel. The lower end of the spring 172 abuts the flat top end 178 of the rod 152 to apply a downward biasing force thereto. The biasing force tends to move the rod to an extended position. The length of the slot 170 and the length of the rod 152 are selected and coordinated such that when the rod is in its retracted position its end portion 180 extends out of the sash's frame and into the insert 126 of the associated carrier, with the rectangular portion of the rod extending into the rectangular passageway 128 in the insert. In the extended position the rod extends further out of the sash's frame such that its circular free end portion 154 extends through the aperture 132 in the carrier insert 126 and sufficiently therebeyond such that when the rod and the associated carrier are aligned with an aperture 150 in the supporting sill track the rod's free end portion 154 positively extends into the aperture.

Accordingly, when the sash 22 is moved to the position within the window frame wherein its pivot assemblies 148 are axially aligned with the apertures 150 in the tracks 34, after the locking fingers 106 have been retracted and the pivot assembly rods 152 moved to their extended position the free end portion 154 of each rod not only extends through the aperture 132 in the associated insert but also extends into the aligned aperture 150 in the track. Since each insert is rotatable in its associated carrier 82 and since each rod 152 extends therethrough, with the flat surfaces of the rod engaging the flat surfaces of the insert's passageway, the insert serves as the pivoting mount for the sash so that the sash can be pivoted out of the plane of its tracks and about the vertical axis defined by the longitudinal axis of the rods 152 and the axially aligned apertures 150.

As should be appreciated by those skilled in the art, the extension of each rod end 154 into the associated track aperture offers a unique safety feature by preventing the tilting of the sash pivot axis from its desired vertical orientation, which action could result in the accidental removal of the window from the frame.

When the sash has been pivoted about the vertical axis 136, as described above and as shown in FIG. 4, both surfaces of its glass panel 40 are readily accessible from one side (i.e., the inner side) of the window.

When it is desired to return the sash 22 to its track 34, the slide buttons 110 on the stile 48 are pulled inward, that is, toward the center of the stile. This action, as described heretofore, retracts the fingers 106, whereupon the sash is then pivoted completely back into its tracks 34. The release of the slide buttons 110 causes the free end of each of the associated fingers to extend into the transverse slot 86 in the associated carrier 80, thereby locking the sash within the tracks and securing it to its carriers 80.

Once the sash 22 is positioned back in its tracks 34 the screws 162 of the pivot assemblies 148 are pulled inward, that is, toward the center of the stile 46. This action retracts the pivot assembly rods 152 until their travel is stopped by the engagement of the screw with the end of the screw receiving slots 170. The retraction of the rods to their retracted position causes the free ends 154 of the pivot assembly rods 152 to move out of the apertures 150 in the tracks, thereby freeing the sash for sliding horizontal movement along the tracks. Each screw 162 is then tightened to cause its head to frictionally engage the underlying channel side walls 158 and thus lock the associated rod 152 in the retracted position.

The pivoting and sliding operation of the sash 24 is effected in an identical manner to that just described with respect to sash 22.

As will be appreciated from the foregoing, the sliding sash of the instant invention not only provides a simple approach for gaining access to the exterior surface of the sash, via the vertical pivot feature, but does so without sacrificing safety. In this regard the pivoting assemblies and coacting carriers of the instant invention enable the sash to be pivoted about a vertical axis safely and securely by the passage of the pivot rods through the carriers and their positive insertion into aligned openings in the window tracks. Accordingly, frictional engagement of the carrier assemblies with the tracks is not relied upon to maintain the sash in the desired vertical orientation when the window is pivoted. This feature is of considerable importance to prevent the sash from falling out of the frame during cleaning or repair of the outside surface thereof.

Moreover, the releasable securement means of the instant invention coact with the remaining carrier members to positively lock the sash within the plane of its frame for a sliding operation, while permitting the quick release of the sash when it is desired to pivot it out of the plane of the frame for cleaning.

Without further elaboration, the foregoing will so fully illustrate my invention that others may, by applying current or future knowledge, readily adapt the same for use under various conditions of service.

What is claimed as the invention is:

1. A panel adapted to slide horizontally along a first track and to pivot about a vertical axis located at a predertimined location in said track, said panel comprising a sash including a stile and a bottom rail, carrier means connected to said bottom rail and disposed within said track to enable said sash to slide therealong, releasable retaining means holding said sash within said track and pivot means mounted on said sash, said carrier means comprising a roller assembly having a body portion, a roller mounted within said body portion and adapted to rotate about a horizontal axis to roll along said track and a rotatable insert mounted on said body portion and rotatable about a vertical axis, said insert including a passageway, said pivot means comprising at least a first reciprocable member having a free end extending vertically, said member being mounted on said sash and arranged to be moved vertically from a retracted position to an extended position wherein said free end extends out of said sash, through said passageway in the insert of said carrier means and into an opening in said track at said predetermined location to provide a vertical axis about which said panel can be pivoted when said retaining means is released.

2. The panel of claim 1 wherein said pivot means comprises biasing means for moving said member to said extended position.

3. The panel of claim 2 wherein said biasing means comprises a spring.

4. The panel of claim 3 wherein said pivot means comprises releasable holding means for securing said member in said retracted position.

5. The panel of claim 4 wherein said releasable holding means comprises a screw.

6. The panel of claim 1 wherein said stile includes a vertical channel therein and wherein said member comprises a rod disposed within said channel for sliding movement therein.

7. The panel of claim 6 wherein said channel includes at least one flat portion and wherein said rod includes at least one flat portion to preclude it from rotating about its longitudinal axis within said channel.

8. The panel of claim 7 wherein said passageway includes a flat side engaging a flat portion of said rod.

9. The panel of claim 8 wherein said releasable retaining means comprises a reciprocable member extending into said track and arranged to be retracted therefrom to enable said panel to be pivoted about said vertical axis.

10. The panel of claim 9 wherein the free end of said rod is of circular cross section.

11. The panel of claim 1 wherein said panel includes a top rail to which carrier means are connected to enable said sash to slide horizontally along a second track as it slides along said first track and wherein said pivot means comprises a second reciprocable member having a free end extending vertically, said second member being mounted on said sash, the free end of said first and second members being coaxial, said last mentioned carrier means being of the same construction as said first mentioned carrier means, said second member being arranged to be moved vertically from a retracted position to an extended position wherein its free end extends out of said sash, through a passageway in the insert of said last mentioned carrier means and into an opening in said second track at said predetermined position.

12. The panel of claim 11 wherein said members are each elongated rods, each of said rods being disposed within respective channel portion in said stile, and biasing means for moving each of said rods to said extended position.

13. The panel of claim 12 wherein said biasing means comprises a respective spring for each of said rods.

14. The panel of claim 12 additionally comprising releasable holding means for securing each of said rods in said retracted position.

15. The panel of claim 14 wherein each of said releasable holding means comprises a screw.

* * * * *